United States Patent [19]

Desai

[11] 4,381,955

[45] May 3, 1983

[54] GOLD BASED ELECTRICAL CONTACT MATERIALS, AND METHOD THEREFOR

[75] Inventor: Jaydev D. Desai, Clifton Park, N.Y.

[73] Assignee: The United States of America as represented by the Secretary of the Navy, Washington, D.C.

[21] Appl. No.: 255,081

[22] Filed: Apr. 17, 1981

[51] Int. Cl.[3] ..... C21D 1/56

[52] U.S. Cl. ..... 148/20.3; 148/20.6; 148/13; 420/507

[58] Field of Search ..... 148/13, 13.1, 20, 20.3, 148/20.6; 75/165

[56] References Cited

U.S. PATENT DOCUMENTS

| | | | |
|---|---|---|---|
| 2,032,694 | 3/1936 | Gertler | 148/13.1 |
| 2,148,040 | 2/1939 | Schwarzkopf | 29/188 |
| 2,413,928 | 1/1947 | Simpson | 148/13.1 |
| 3,099,589 | 7/1963 | Tanaka | 148/20.3 |
| 3,153,163 | 10/1964 | Foldes et al. | 310/231 |
| 3,197,346 | 7/1965 | Munday | 148/13.1 |
| 3,650,850 | 3/1972 | Corth et al. | 148/13.1 |
| 3,830,670 | 8/1974 | Van Thyne et al. | 148/20.3 |
| 3,992,199 | 11/1976 | Neely | 75/200 |
| 4,253,885 | 3/1981 | Maurer et al. | 148/13.1 |
| 4,268,323 | 5/1981 | Jakubowski et al. | 148/20 |
| 4,306,918 | 12/1981 | Kaspersma et al. | 148/20.3 |

*Primary Examiner*—John P. Sheehan

*Attorney, Agent, or Firm*—Robert F. Beers; Frederick A. Wein

[57] ABSTRACT

There is presented gold based contact materials fabricated by internal carburization and method therefor. Carburizable refractory elements are carburized by internal carburization by exposing a gold based solid solution containing the refractory element to an atmosphere of a gaseous oxide of carbon at an elevated temperature. The elevated temperature is chosen to be below the melting point of the solid solution and high enough to cause gaseous decomposition of a carbon material packed with the solid solution within an enclosing container. The carburizable refractory element with the solid solution is preferentially carburized by the gaseous oxide of carbon to form hard, refractory second phase carbide particles within the gold matrix.

6 Claims, No Drawings

GOLD BASED ELECTRICAL CONTACT MATERIALS, AND METHOD THEREFOR

BACKGROUND OF THE INVENTION

The present invention relates to low energy slip rings, and more particularly, to gold based contact materials fabricated by internal carburization for use as slip ring material.

Materials suitable for use in low energy slip rings should have high wear resistance, low contact resistance, and a homogenous and uncontaminated microstructure. Accordingly, such materials must have high conductivity, high hardness and wear resistance, high tarnish resistance, low contact noise, and little or no tendancy towards catalytic formation of friction polymers. In the past, these considerations have led to a virtually exclusive dependance upon gold based materials. Currently used gold based materials utilize cold working, solid solution hardening, precipitation hardening, or order hardening which generally benefits strength, hardness and wear resistance but have detrimental effects on the electrical and chemical properties of gold.

Nickel, cobalt, or cadmimum hardened electroplated gold exhibit high hardness, high wear resistance and have a reasonably high conductivity, but such materials often have included contaminants such as, KCN, porosity, codeposited polymers, and the like. Moreover, it is hypothesized that such materials have a non-homogenous structure. Additionally, the properties of hardened electroplated gold are strongly dependant upon the substrate and plating conditions. Thus, consistently high quality electroplates require not easily achieved stringent controls during processing. Accordingly, it is desirable to provide a gold-based material which will exhibit high hardness with high wear resistance, high strength, and high conductivity with a homogeneous and uncontaminated structure.

SUMMARY OF THE INVENTION

Briefly, gold based contact materials fabricated by internal carburization are presented. A solid solution comprising gold alloyed with a carburizable refractory element is exposed to a gaseous oxide of carbon at a predetermined elevated temperature below the melting temperature of the solid solution to form hard, refractory second phase carbide particles by internal carburization. These refractory elements are partially or completely removed from the alloy by the preferential carburization but remain in the crystal matrix with an effect of a simultaneous increase in strength, hardness, wear resistance and electrical conductivity as compared with the alloyed material.

OBJECTS OF THE INVENTION

Accordingly, it is an object of the present invention to provide gold based contact materials fabricated by internal carburization and a method therefor. Another object of the present invention is to provide gold based contact materials fabricated by internal carburization exhibiting high wear resistance, high hardness, high strength and high conductivity with a homogeneous and uncontaminated structure. Still another object of the present invention is to provide gold based contact materials fabricated by exposing a solid solution of gold and a carburizable refractory element to a gaseous oxide of carbon at a temperature below the melting temperature of the solid solution to form hard, refractory second phase carbide particles by internal carburization.

Further objects and advantages of the present invention will become apparent as the following description proceeds and the features of novelty characterizing the invention will be pointed out with particularity in the claims annexed to and forming a part of this specification.

DETAILED DESCRIPTION OF THE PREFERRED EMBODIMENT

The present invention relates to gold-based contact materials fabricated by internal carburization and method therefor for slip ring and other contact applications. Gold-carbide materials, e.g., WC, TiC, as the second phase, have been prepared in the past by chemical means and electro-deposition. However, as disclosed herein, internal carburization provides a superior approach for preparing carbide-dispersion strengthened gold-based solid solution alloys.

A solid solution is formed of the desired alloy by casting gold with one of the carbide forming refractory elements, e.g., Ti, Ta, Hf, V, Nd, Zr and Cr. In the exemplary embodiment, gold alloys having 8% Cr, 7.5% Ta, 2.2% Ti and 5% V were prepared by mixing 99.999% gold with the respective high purity second carburizable refractory element, and melting and casting the alloy in a copper mold in an argon atmosphere. These alloy compositions were chosen such that alloying elements will remain in solid solution in the gold.

All or a portion of the carburizable refractory element is than preferentially carburized by subjecting the cast alloy to a carburizing treatment. In the exemplary embodiment, the cast alloy was packed with carbon or coke in a suitable enclosure at a temperature of 1,000° C. for 47 hours. The temperature of 1,000° C. was chosen to be close to but below the melting temperature of the solid solution, and high enough such that the carbon material, e.g., carbon or coke, will decompose forming an atmosphere of CO or $CO_2$, gaseous oxides of carbon. Such internal carburization treatment causes hard refractory second phase carbide particles to be formed within the casting which are no longer alloyed in the solid solution but remain in the crystal matrix.

The result of this treatment is a simultaneous increase in strength, hardness, wear resistance and electrical conductivity. Additionally, the material also exhibits a homogeneous and uncontaminated structure. Moreover, as compared to the conventional powder metallurgy approach, the disclosed process produces finer and more uniformly distributed second phase particles as well as superior coherency and bonding at the gold matrix particle interface. Thus, the hardening and wear resisting characteristics will exist throughout the material and the electrical conductivity will not be impaired by the hard second phase carbide particles. The fine, uniformly distributed particles are excellent from an electrical contact standpoint in that the few conducting areas within the contact zone, although only a few microns in diameter, will each contain several of these carbide particles along with gold matrix. It was found that the alloy of 5% V showed the best distribution of carbide particles when examined metallagraphically.

The following microhardness measurements were made on these alloys after internal carburization at 100 gram load with load duration of 10 seconds as shown in table 1:

TABLE I

| | MICROHARDNESS DPH |
|---|---|
| Au - 8% Cr | 94 |
| Au - 7.5% Ta | 97 |
| Au - 2.2% Ti | 201 |
| Au - 5.5% V | 37 |
| Pure Gold | 35 |

where the percentages are by weight and DPH is Diamond Pyramid Hardness.

Thus, there is presented gold-based contact materials fabricated by internal carburization and method therefor wherein carbide materials of refractory elements are produced by internal carburization by exposing the gold based solid solution containing the carburizable refractory element to an atmosphere of a gaseous oxide of carbon at an elevated temperature. The elevated temperature is chosen to be below the melting point of the solid solution and high enough to cause gaseous decomposition of a carbon material packed with a casting of the solid solution within an enclosing container. The carburizable refractory element within the solid solution is preferentially carburized by the gaseous oxide of carbon to form hard, refractory second phase carbide particles with the gold matrix.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. A method of carburizing by internal carburization a carburizable refractory element in a solid solution with gold comprising the steps of:

enclosing the solid solution and a temperature decomposable carbon material, and subjecting the solid solution and the carbon bearing material to a predetermined temperature below the melting temperature of the solid solution and higher than the decomposition temperature of the carbon material for a predetermined period of time.

2. A method of carburizing a carburizable refractory element in a solid solution with gold comprising the steps of:

enclosing the solid solution and a temperature decomposable carbon material, and subjecting the solid solution and the carbon material to a predetermined temperature below the melting temperature of the solid solution and higher than the decomposition temperature of the carbon material for a predetermined period of time, the carbon material being chosen to generate a gaseous oxide of carbon at the predetermined temperature, the gaseous oxide of carbon preferentially carburizing the carburizable refractory element by internal carburization to form carbide particles of the carburizable refractory element within the solid solution.

3. A method of carburizing by internal carburization a carburizable refractory element in a solid solution with gold comprising the steps of:

providing a carbon material in a close proximity to the solid solution, elevating the temperature of the solid solution and the carbon bearing material, the carbon material having been chosen for generating a gaseous oxide of carbon at a predetermined temperature below the melting temperature of the solid solution, and subjecting the solid solution to the gaseous oxide of carbon for a predetermined period of time sufficient for at least a portion of the refractory element to carburize, by internal carburization, forming carbide particles of the refractory element within the solid solution.

4. A method for forming by internal carburization a carbide dispersion of a carburizable refractory element in a solid solution with gold comprising the steps of:

enclosing the solid solution and a temperature decomposable carbon bearing material, and subjecting the solid solution and the carbon bearing material to a temperature below the melting temperature of the solid solution and higher than the decomposition temperature of the carbon bearing material for a predetermined period of time for forming by internal carburization carbide particles of the carburizable refractory element within the solid solution.

5. The method of claims 1, 2 or 4 wherein the carburizable refractory element is selected from a group consisting of Ti, Ta, Hf, V, Nb, Zr, Cr and W.

6. The method of claim 3, wherein the carburizable refractory element is selected from a group consisting of Ti, Ta, Hf, V, Nb, Zr, Cr and W.

* * * * *